US005974989A

United States Patent [19]

Liu

[11] Patent Number: 5,974,989

[45] Date of Patent: Nov. 2, 1999

[54] SEWING MACHINE TYPE DECORATIVE BOX

[76] Inventor: Jack Liu, No. 3, Alley 202, Kao-Don Rd., Hsin-Chu City, Taiwan

[21] Appl. No.: 09/015,247

[22] Filed: Jan. 29, 1998

[51] Int. Cl.[6] ..... D05B 23/00; G10F 1/06

[52] U.S. Cl. ..... 112/1; 112/220; 84/94.2; 446/298; 446/474

[58] Field of Search ..... 112/220, 221, 112/258, 259, 1; 84/95.2, 95.1, 94.2; 446/298, 474; 40/446

[56] References Cited

U.S. PATENT DOCUMENTS

| | | | |
|---|---|---|---|
| 3,482,345 | 12/1969 | Crawford | 446/474 |
| 3,699,705 | 10/1972 | Clarke et al. | 40/446 |
| 5,696,333 | 12/1997 | Shih | 84/95.2 |

*Primary Examiner*—Peter Nerbun
*Attorney, Agent, or Firm*—Smith, Gambrell & Russell, LLP; Beveridge, DeGrandi, Weilacher & Young Intellectual Property Group

[57] ABSTRACT

A sewing machine type decorative box includes a sewing machine body and a box engaged with the sewing machine body. A music device is provided within the box, and this music device includes a rolling wheel and an end gear connected at a first end of the wheel. A rotary disk also is installed within the box, wherein a periphery of the rotary disk engages the end gear of the music device. Additionally, a rod is provided that rotates along with the rotary disk. The sewing machine body includes first and second transverse axes. A first gear is provided at a first end of the first transverse axis, and an eccentric cam is provided at a second end of the first transverse axis. The second transverse axis includes a gear at one end that engages with the first gear of the first transverse axis. A longitudinal driving axis extends between the sewing machine body and the box. A first end of this driving axis includes an element that engages with the rod of the rotary disk, and the second transverse axis is driven by this driving axis. Finally, a longitudinal axis is installed at the cam of the first transverse axis. A cambered guiding piece, which is integrally formed with the longitudinal axis, engages a periphery of the cam to move the longitudinal axis up and down, simulating the motion of a sewing machine.

15 Claims, 2 Drawing Sheets

SEWING MACHINE TYPE DECORATIVE BOX

BACKGROUND OF THE INVENTION

1. Field of the Invention

The present invention is related to a decorative box, and especially to a decorative box which can simulate the action of a conventional sewing machine.

2. Description of the Prior Art

According to the structure of a conventional sewing machine, a transverse rotary axis is installed within the sewing machine body. A rotary disk that may be driven by a pulley is installed on one end of the rotary axis, while a longitudinal axis is installed on another side of the rotary axis within the sewing machine body. The longitudinal axis may be driven to longitudinally move forward and backward by the movement of the rotary axis. A needle is fixed below the lower end of the longitudinal axis, through which the sewing machine may perform predetermined work.

SUMMARY OF THE INVENTION

Considering the action mode of the sewing machine in the prior art, the present invention has been designed to be used as a sewing machine decoration. The structure comprises a sewing machine body and a box below a lower end of the sewing machine body. A rotary disk may be driven by an end gear of a music device installed within the box. A transverse axis within the sewing machine body may be driven to rotate by the rotary disk through a gear. A longitudinal axis, installed at one end of the transverse axis, may be driven by a cam operatively connected with the transverse axis such that the longitudinal axis moves upward and downward.

By driving the disks and gears in the structure, the present invention may simulate the action of a sewing machine body.

Further, an interesting decoration is adhered at a proper position of the driving structure. In operation, the decoration may be driven to present an interesting appearance.

BRIEF DESCRIPTION OF THE DRAWINGS

The present invention will be better understood and its numerous objects and advantages will become apparent to those skilled in the art by reference to the attached drawings in which.

DETAILED DESCRIPTION OF THE PREFERRED EMBODIMENT

Figure 1:
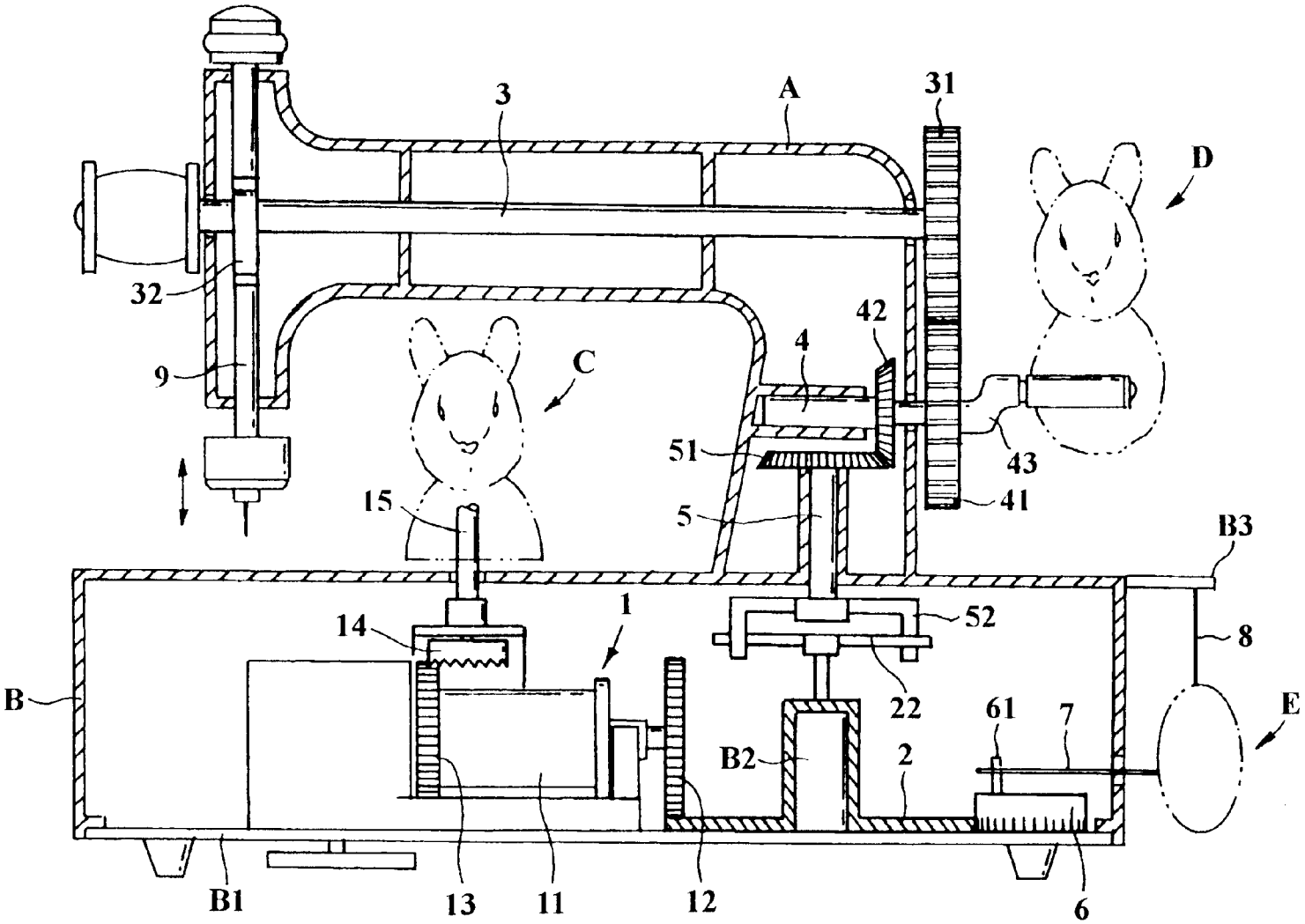
FIG. 1 is a front cross sectional view of the present invention.
Figure 2:
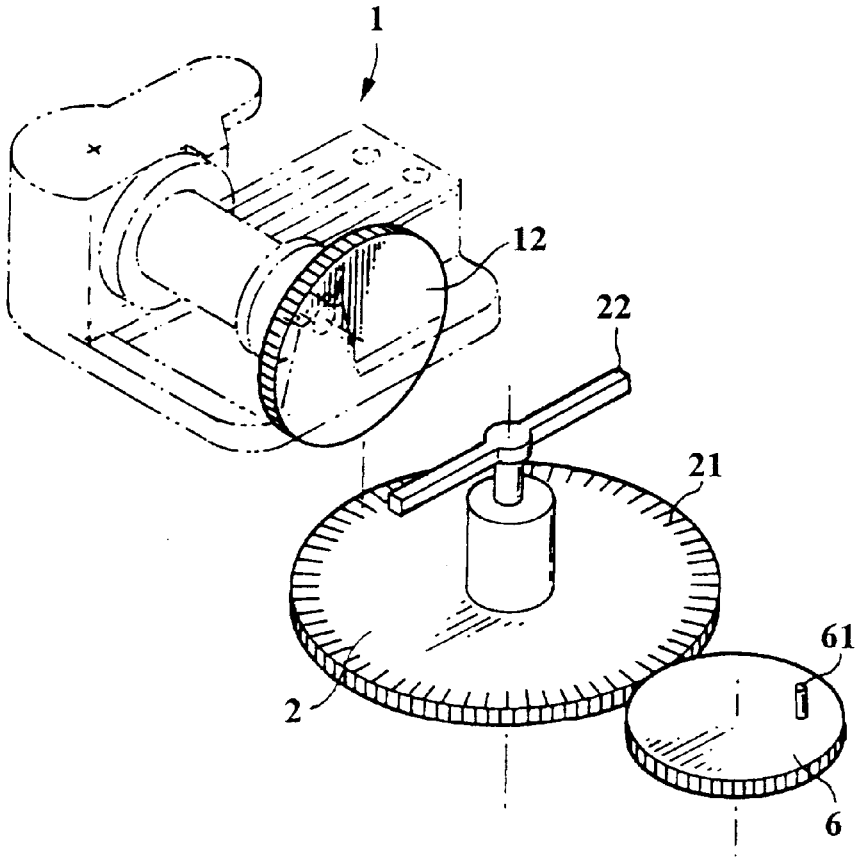
FIG. 2 is a partial perspective and schematic view of the present invention, which shows the relative position of the end gear of the music device and the rotary disk.

The detailed structure of the present invention is shown in FIGS. 1 and 2. The apparatus of the invention comprises a sewing machine body (A) and a box (B) below the sewing machine body (A).

A music device (1) is installed on the box (B) and an end gear (12) is installed on an end portion of a rolling wheel (11) of the music device (1).

In addition, a rotary disk (2), the rotary axial center of which extends to the base (B1), is installed in the box (B). A ring gear (21) corresponding to the end gear (12) is formed on a peripheral rim of an upper surface of the rotary disk (2). A transverse elastic rod (22) of proper height longitudinally extends from a center of the rotary disk (2).

Moreover, a crown gear (14) is installed above a driving gear (13) on the opposite end of the rolling wheel (11) of the music device (1) from the end gear (12). A decoration (C) is fixed on the end portion of a longitudinal rotary axis (15) extending from the crown gear (14).

By this structure, as the rolling wheel (11) rotates, the rotary disk (2) is driven to rotate by the end gear (12) of the music device (1). Additionally, the rotation of the rolling wheel (11) will cause the driving gear (13) to drive the crown gear (14) to rotate, which in turn will translate to a dynamic rotation of the decoration (C).

Furthermore, two transverse axes (3, 4) are installed on the sewing machine body (A). An upper gear (31) is installed outside the sewing machine body (A) on one end of the transverse axis (3), and a cam (32) eccentric to the transverse axis (3) is installed on the opposite end of the transverse axis (3).

Next, a lower gear (41) is engaged with the upper gear (31) and installed outside the sewing machine body (A) on one end of the transverse axis (4). A longitudinal inclined gear (42) is installed on the transverse axis (4) inside the sewing machine body (A).

Additionally, a longitudinal driving axis (5) is installed below the transverse axis (4). A transverse inclined gear (51) is installed on an upper end of the driving axis (5) and is engaged with the longitudinal inclined gear (42). An elastic element (52) corresponding to the elastic rod (22) of the rotary disk (2) is installed on the lower end of the driving axis (5).

As the music device (1) provides power to drive the rotary disk (2) to rotate, the driving axis (5) may be driven to rotate by the elastic rod (22) through the elastic element (52).

Rotation of the driving axis (5) may be driven through the inclined gears (51, 42) to cause the lower gear (41) and the upper gear (31) to rotate, thereby driving the transverse axes (3, 4) to also rotate.

A crank axis (43) is installed on the axial center of the transverse axis (4) and the lower gear (41), and a decoration (D) is installed on the crank axis (43). This decoration (D) may be rotated along the rotary arc of the crank axis (43) so to provide another dynamic motion.

Figure 3:
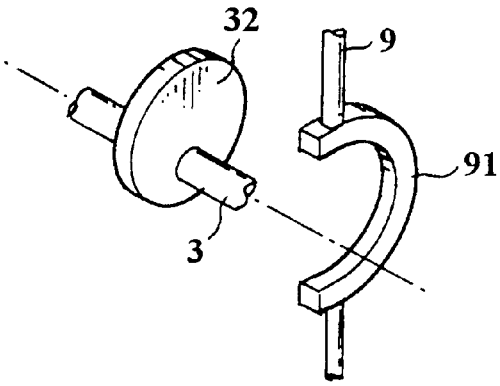
FIG. 3 is a perspective view illustrating the cam of the transverse axis and the guiding piece of the longitudinal axis.
Figure 4:
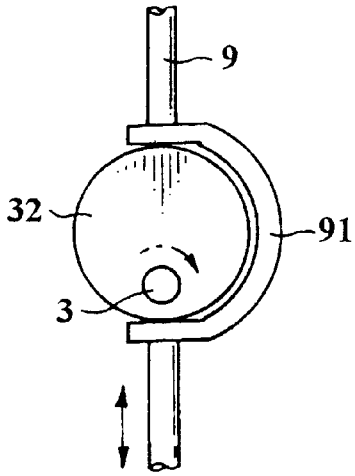
FIG. 4 is a front view of FIG. 3.

Moreover, a longitudinal axis (9) is installed at the cam (32) of the transverse axis (3), and a cambered guiding piece (91) is formed at an appropriate position of the longitudinal axis (9) corresponding to the cam (32), as shown in FIGS. 3 and 4. Therefore, when the guiding piece (91) is engaged with the cam (32), the eccentric cam (32) will drive the longitudinal axis (9) to move upward and downward, such that a needle provided on the lower end of the longitudinal axis (9) will simulate the operation of a sewing machine.

In order to further extend the dynamic phenomenon of the present invention, a subgear (6), which may be driven to rotate by the rotary disk (2), is installed on one side of the rotary disk (2). An eccentric axis (61) is installed on a surface of the subgear (6). Moreover, a decoration (E) is hung from a rope (8) on the outer frame (B3) of the box (B), and a push rod is connected between the decoration (E) and the subgear (6). As the rotary disk (2) is rotated to drive the subgear (6) to rotate, the eccentric axis (61) thereof will push the decoration (E) to swing transverse and repeatedly along the push rod (7).

Although a certain preferred embodiment of the present invention has been shown and described in detail, it should be understood that various changes and modification may be made without departing from the scope of the appended claims.

understood that various changes and modification may be made without departing from the scope of the appended claims.

Description of Certain Numerals in the FIGS.

| | | | |
|---|---|---|---|
| A | sewing machine body | B | box |
| C,D,E | decoration | | |
| 1 | music device | 11 | rolling wheel |
| 12 | end gear | 13 | driving gear |
| 14 | crown gear | | |
| 2 | rotary disk | 22 | elastic rod |
| 3,4 | transverse axes | 31 | upper gear |
| 41 | lower gear | | |
| 5 | longitudinal driving axis | 52 | elastic element |
| 6 | subgear | 61 | eccentric axis |
| 9 | longitudinal axis | 91 | guiding piece |

What is claimed is:

1. A sewing machine type decorative box comprising a sewing machine body and a box below the sewing machine body, characterized by:

a rotary disk installed within said box, wherein a periphery of said rotary disk is engaged with an end gear of a music device; and an elastic rod longitudinally extended from a center of the rotary disk;

a first transverse axis installed within said sewing machine body; wherein an upper gear is installed at a first end of the first transverse axis and an eccentric cam is installed at a second end of the first transverse axis;

a second transverse axis installed within said sewing machine body; wherein a lower gear is engaged with said upper gear and is installed outside the sewing machine body at a first end of the second transverse axis;

a longitudinal driving axis installed below said second transverse axis, and wherein an elastic element connected to said rotary disk through said elastic rod is installed on a lower end of said driving axis; and wherein said second transverse axis is driven by said driving axis through a gear; and a longitudinal axis installed at the cam of said first transverse axis, and wherein a cambered guiding piece is integrally formed with the longitudinal axis and engages a periphery of said cam.

2. The sewing machine type decorative box as claimed in claim 1, further including a crown gear installed above a driving gear of a rolling wheel of said music device.

3. The sewing machine type decorative box as claimed in claim 1, further including a crank axis installed on an axial center of said upper gear or said lower gear.

4. The sewing machine type decorative box as claimed in claim 1, further including a subgear driven to rotate by said rotary disk and installed on one side of said rotary disk, and an eccentric axis installed on a surface of said subgear.

5. The sewing machine type decorative box as claimed in claim 4, further including a decoration hung on an outer frame of said box, and a push rod connected between the decoration and the subgear.

6. A sewing machine type decorative box comprising:

a sewing machine body;

a box engaged with the sewing machine body;

a music device within the box, wherein the music device includes a wheel and an end gear connected at a first end of the wheel;

a rotary disk installed within the box, wherein a periphery of the rotary disk is engaged with the end gear of the music device, and wherein a rod is provided that moves with the rotary disk;

a first transverse axis installed within the sewing machine body, wherein a first gear is provided at a first end of the first transverse axis and an eccentric cam is provided at a second end of the first transverse axis;

a second transverse axis installed within said sewing machine body, wherein a second gear is provided at a first end of the second transverse axis and wherein the second gear is engaged with the first gear;

a longitudinal driving axis extending between the sewing machine body and the box, wherein a first end of the driving axis includes an element that engages the rod of the rotary disk, and wherein the second transverse axis is driven by the driving axis;

a longitudinal axis installed at the cam of the first transverse axis; and a cambered guiding piece provided with the longitudinal axis, wherein the guiding piece engages a periphery of the cam to move the longitudinal axis upward and downward.

7. The sewing machine type decorative box as claimed in claim 6, further including a crown gear engaged with a driving gear of the wheel of the music device.

8. The sewing machine type decorative box as claimed in claim 7, further including a shaft extending from the crown gear out of the box.

9. The sewing machine type decorative box as claimed in claim 8, further including a decoration provided on the shaft, wherein the decoration rotates with the shaft and the crown gear.

10. The sewing machine type decorative box as claimed in claim 6, further including a crank axis provided on an axial center of the upper gear or the lower gear.

11. The sewing machine type decorative box as claimed in claim 10, further including a decoration provided on the crank axis, wherein the decoration rotates with the crank axis.

12. The sewing machine type decorative box as claimed in claim 6, further including a subgear provided on one side of the rotary disk and driven to rotate with the rotary disk.

13. The sewing machine type decorative box as claimed in claim 12, further including a decoration engaged with a frame of the box, and a push rod connected between the decoration and the subgear.

14. The sewing machine type decorative box as claimed in claim 12, further including an eccentric axis extending from a surface of the subgear.

15. The sewing machine type decorative box as claimed in claim 14, further including a decoration engaged with a frame of the box, and a push rod connected between the decoration and the eccentric axis.

* * * * *